US005621183A

United States Patent [19]

Bailey

[11] Patent Number: 5,621,183

[45] Date of Patent: Apr. 15, 1997

[54] INITIATOR FOR AN AIR BAG INFLATOR

[75] Inventor: Todd R. Bailey, Mesa, Ariz.

[73] Assignee: TRW Inc., Lyndhurst, Ohio

[21] Appl. No.: 371,762

[22] Filed: Jan. 12, 1995

[51] Int. Cl.[6] ..... F42C 19/02; F42C 19/12

[52] U.S. Cl. ..... 102/202.7; 102/202.14; 102/202.9

[58] Field of Search ..... 102/202.14, 202.9, 102/202.5, 202.7, 202.12; 280/741; 220/320

[56] References Cited

U.S. PATENT DOCUMENTS

| | | | |
|---|---|---|---|
| 3,971,320 | 7/1976 | Lee | 102/202.9 |
| 4,402,269 | 9/1983 | Smith | 102/202.13 |
| 4,592,280 | 6/1986 | Shores | 102/202.2 |
| 4,778,074 | 10/1988 | Kelly | 220/4 R |
| 4,959,011 | 9/1990 | Nilsson | 431/263 |
| 5,088,412 | 2/1992 | Patrichi | 102/202.13 |
| 5,140,906 | 8/1992 | Little, II | 102/202.14 |
| 5,142,982 | 9/1992 | Diepold et al. | 102/202.5 |
| 5,243,493 | 9/1993 | Marquit et al. | 361/247 |
| 5,403,036 | 4/1995 | Zakula et al. | 280/741 |
| 5,404,263 | 4/1995 | Graves et al. | 361/247 |
| 5,433,147 | 7/1995 | Brede et al. | 102/202.2 |

OTHER PUBLICATIONS

Raychem Corporation, Six page product brochure, "Unilok Rings", May 1991.

Special Devices, Incorporated, two pages of drawings of initiators, dated prior to applicant's invention.

*Primary Examiner*—Michael J. Carone

*Assistant Examiner*—Christopher K. Montgomery

*Attorney, Agent, or Firm*—Tarolli, Sundheim, Covell, Tummino & Szabo

[57] ABSTRACT

An electrically actuatable initiator (10) for an air bag inflator (20) includes an electrically sensitive ignition charge (280) disposed in an electrically conductive ignition cup (290). A plastic insulation cup (320) overlies the ignition cup (290). The insulation cup (320) electrically insulates the ignition cup (290) to block the flow of electric current into the ignition cup to prevent unintended actuation of the ignition charge (280). A locking ring member (380) is made from a shape-memory alloy which shrinks in diameter when heated above a predetermined temperature. The locking ring member (380) secures an output cup (360) to a retainer (150) and hermetically seals between the output cup and the retainer. A second locking ring member (310) secures the ignition cup (290) to a header (150) and seals between the ignition cup and the header.

26 Claims, 4 Drawing Sheets

INITIATOR FOR AN AIR BAG INFLATOR

BACKGROUND OF THE INVENTION

1. Technical Field

The present invention relates to an apparatus for inflating a vehicle occupant restraint, and particularly relates to an electrically actuatable initiator for an air bag inflator.

2. Description of the Prior Art

It is known to protect a vehicle occupant by an air bag that is inflated in the event of sudden vehicle deceleration such as occurs in a vehicle collision. The air bag restrains movement of the vehicle occupant during the collision. The air bag is inflated by inflation fluid from an inflator. The inflation fluid may be stored gas which is released from the inflator and/or gas generated by ignition of combustible gas generating material in the inflator. The inflator uses an electrically actuatable initiator to open the container to release the stored gas and/or to ignite the gas generating material.

The initiator typically includes a pyrotechnic ignition charge. The ignition charge may be electrically sensitive and may need to be insulated from stray electric currents or sparks to prevent inadvertent actuation of the ignition charge. In some initiators, the ignition charge is electrically insulated by an external layer of plastic which overlies an outer metal shell of the initiator. No internal electrical insulation of the ignition charge is provided. An external plastic film is susceptible to damage and, if damaged, may lose its electrical insulating capabilities.

The pyrotechnic material in an initiator may also be adversely affected by exposure to contaminants such as air or moisture. It is thus desirable to block the conduction of air, moisture, or other contaminants to pyrotechnic material within an initiator such as the ignition charge. This is typically done by welding together metal parts of the initiator, such as a cover and a base.

SUMMARY OF THE INVENTION

The present invention is an electrically actuatable initiator comprising a support member, a pyrotechnic charge, an electrical conductor, and means for igniting the pyrotechnic charge in response to the conduction of electric current through the electrical conductor. The initiator includes a cover for the pyrotechnic charge, and sealing means for sealing the cover to the support member. The sealing means comprises a locking ring member circumscribing the cover and compressing the cover radially inward onto the support member to seal the cover to the support member.

The present invention is also an electrically actuatable initiator including a retainer, at least one terminal for electrical connection with vehicle circuitry, and means for supporting the terminal in spaced relation to the retainer and for providing electrical insulation between the terminal and the retainer. A bridgewire associated with the terminal generates thermal energy when electrically actuated by current from the terminal. An ignition charge is ignitable by the thermal energy. A metal ignition cup encloses and supports the ignition charge. The metal ignition cup is spaced apart from the retainer. A plastic insulation cup overlies the metal ignition cup and electrically insulates the metal ignition cup. An electrically conductive output charge overlies the insulation cup, and an electrically conductive output cup overlies the output charge. The insulation cup blocks flow of electric current from the output charge or the output cup to the ignition cup.

The field of use of the present invention is not limited to initiators for air bag inflators. Accordingly, the present invention is also an apparatus comprising a first electrically conductive metallic member having first surface means for defining a first passage extending through the first member, and a second electrically conductive metallic member spaced apart from the first member. The second member has second surface means for defining a second passage extending through the second metallic member. The first and second passages extend generally parallel to an axis of the apparatus. An electrically conductive first metallic electrode is bonded to the second member and extends through the first passage in the first member. An electrically conductive second metallic electrode extends through the first passage in the first member and through the second passage in the second member. The first and second electrodes extend generally parallel to the axis. The second passage has a second passage portion encircling the second metallic electrode. A first body of solid electrically insulating glass-like ceramic material is fused to the first surface means defining the first passage in the first member and spans the first passage. The first body is fused to the first and second electrodes in the first passage, and is also fused to the second member and spans the second passage portion between the second electrode and the second member. A second body of solid electrically insulating ferrite material is in the second passage portion in the second member. The second body has an opening through which the second electrode passes.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF PREFERRED EMBODIMENTS OF THE INVENTION

Figure 1:
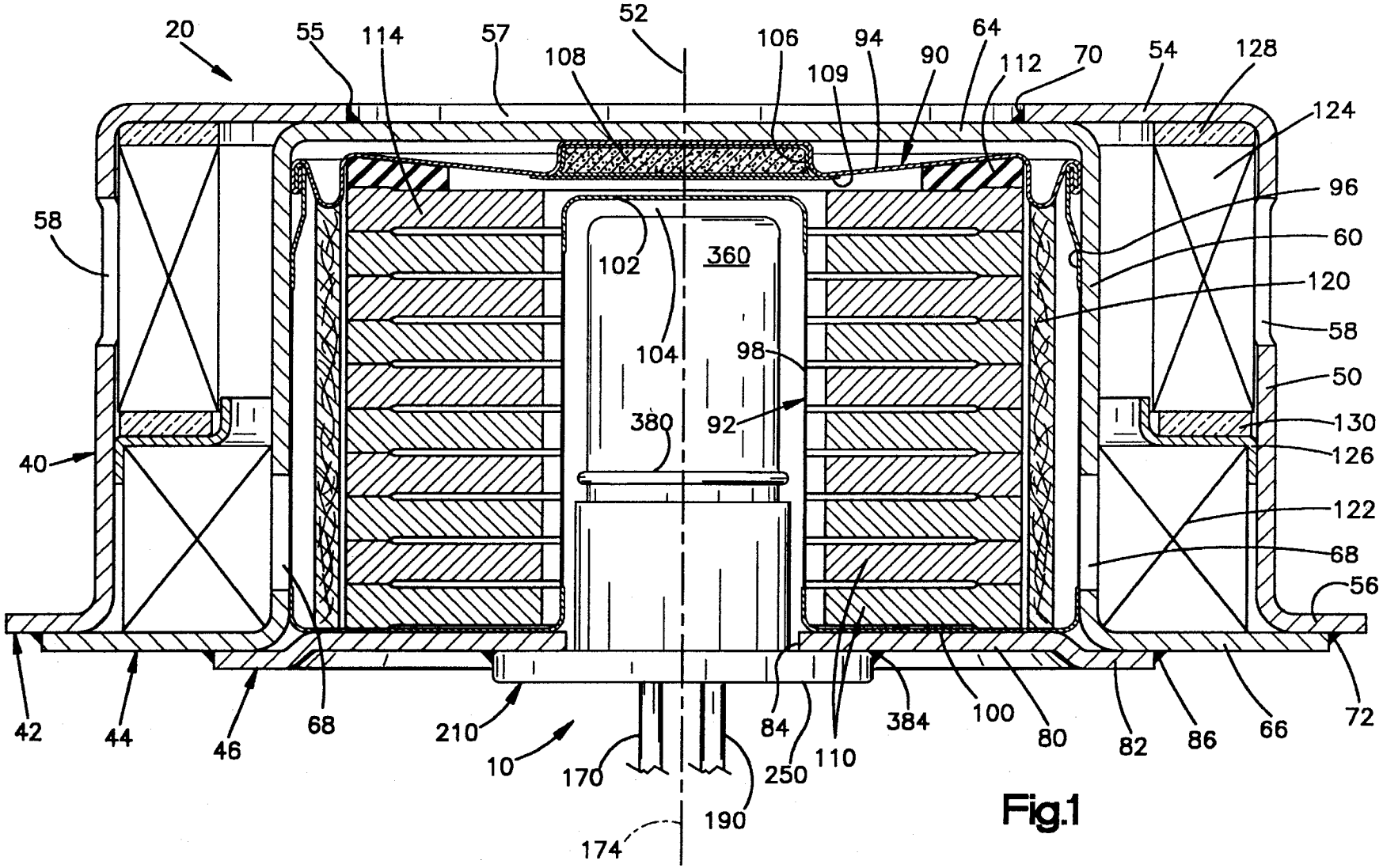
FIG. 1 is a transverse axial sectional view of an inflator including an initiator assembly constructed in accordance with the present invention.

The present invention relates to an electrically actuatable initiator and preferably an initiator for an air bag inflator. The present invention is applicable to various initiator constructions, including initiators for inflators with different modes of operation. For example, the invention can be applied to initiators for inflators which release gas from a container and/or which generate gas by ignition of combustible gas generating material. As representative of the present invention, FIG. 1 illustrates an initiator 10.

The initiator 10 is incorporated in an air bag inflator 20. The inflator 20 is of the type disclosed in U.S. Pat. No. 5,178,547, and includes a housing 40. The housing 40 is made of three pieces, namely, a diffuser cup 42, a combustion cup 44, and a combustion chamber cover 46. The diffuser cup 42, the combustion cup 44, and the combustion chamber cover 46 are made of a metal, such as UNS S30100 stainless steel.

The diffuser cup 42 is generally cup-shaped and has a cylindrical side wall 50 extending around the central axis 52 of the inflator 20. The side wall 50 extends between a flat upper end wall 54 and a flat lower flange 56. An inner annular surface 55 on the upper end wall 54 of the diffuser cup 42 defines a central opening 57 in the upper end wall 54. The end wall 54 and the flange 56 are generally parallel to each other and perpendicular to the axis 52. An annular array of gas outlet openings 58 is located in an upper portion of the diffuser cup side wall 50.

The combustion cup 44 is generally cup-shaped and is disposed inside the diffuser cup 42. The combustion cup 44 has a cylindrical side wall 60 extending around the axis 52. The cylindrical side wall 60 extends between a flat upper end wall 64 and a flat lower flange 66. The upper end wall 64 and the lower flange 66 are generally parallel to each other and perpendicular to the axis 52. An annular array of openings 68 is located in a lower portion of the combustion cup side wall 60.

The upper end wall 64 of the combustion cup 44 is welded with a continuous weld to the annular surface 55 on the upper end wall 54 of the diffuser cup 42 at a circumferential weld location 70, preferably by laser welding. The combustion cup flange 66 is welded with a continuous weld to the diffuser cup flange 56 at a circumferential weld location 72, also preferably by laser welding.

The combustion chamber cover 46 is a generally flat metal piece having a circular center portion 80 and a parallel but slightly offset circular outer flange 82. A circular opening 84 is located in the center portion 80 of the chamber cover 46. The outer flange 82 of the chamber cover 46 is welded with a continuous weld to the combustion cup flange 66 at a circumferential weld location 86, again preferably by laser welding.

A hermetically sealed canister 90 is disposed in the combustion cup 44. The canister 90 is made of two pieces, namely a lower canister section 92 and a cover 94. The radially outer edge of the canister cover 94 is crimped to an adjacent edge of the canister lower section 92 to seal the canister 90 hermetically. The canister 90 is preferably made of relatively thin aluminum.

The canister lower section 92 has a cylindrical outer side wall 96 adjacent to and inside the combustion cup side wall 60. The side wall 96 has a reduced thickness in the area adjacent the openings 68 in the combustion cup side wall 60. The canister lower section 92 also has a cylindrical inner side wall 98 spaced radially inwardly from the outer side wall 96. The side wall 98 has a reduced thickness in the area adjacent the initiator 10.

A flat ring-shaped lower wall 100 of the canister lower section 92 interconnects the outer side wall 96 and the inner side wall 98. A circular inner top wall 102 of the canister lower section 92 extends radially inwardly from and caps the inner side wall 98. The inner top wall 102 and the cylindrical inner side wall 98 define a downwardly opening central recess 104 in the canister 90.

The canister cover 94 is generally circular in shape. A recess 106 is located in the center of the canister cover 94. A packet 108 of auto ignition material is located in the recess 106 and held in the recess 106 by a piece of aluminum foil tape 109.

A plurality of annular disks 110 of gas generating material are stacked atop each other within the canister 90. An annular cushion 112 is disposed between the uppermost gas generating disk 114 and the inside of the canister cover 94. The disks 110 are made of a known material which, when ignited, generates nitrogen gas. Although many types of gas generating material could be used, suitable gas generating materials are disclosed in U.S. Pat. No. 3,895,098.

An annular prefilter 120 is disposed in the canister 90. The prefilter 120 is located radially outward of the gas generating disks 110 and radially inward of the outer side wall 96 of the canister 90. A small annular space exists between the prefilter 120 and the outer side wall 96.

An annular slag screen indicated schematically at 122 is located in the diffuser cup 42, outside of the combustion cup 44. The slag screen 122 is radially outward of the openings 68 and lies against the combustion cup side wall 60. However, the slag screen 122 could be spaced away from the openings 68 in the combustion cup side wall 60.

An annular final filter assembly indicated schematically at 124 is located inside the diffuser cup 42 above the slag screen 122. The final filter assembly 124 is radially inward of the gas outlet openings 58 in the side wall 50 of the diffuser cup 42. The final filter assembly 124 is a plurality of layers of various materials. The layers extend around the diffuser cup side wall 50 and are located inside the side wall. The detailed structure of the final filter assembly 124 does not form a part of the present invention and therefore will not be described in detail.

An annular filter shield 126 projects radially inwardly from the diffuser cup side wall 50 and separates the final filter assembly 124 and the slag screen 122. An annular graphite seal 128 seals the gap between the upper edge of the final filter assembly 124 and the inside of the diffuser cup upper end wall 54. Another annular graphite seal 130 seals the gap between the lower edge of the final filter assembly 124 and the upper side of the filter shield 126.

The initiator 10 (FIGS. 2–5) includes a header 150 which is a generally cylindrical metal block preferably made from powder metal processed 304L stainless steel. The header 150 has a cylindrical outer surface 152. A circumferential groove 154 (FIGS. 2 and 5) with a rectangular cross-sectional configuration is formed on the outer periphery of the header 150. The header 150 has parallel radially extending, circular inner and outer end surfaces 156 and 158. An inner surface 160 defines a cylindrical opening 162 extending axially through the header 150 between the end surfaces 156 and 158.

A first conductor pin or terminal 170 (FIG. 2) is connected with the header 150. The first terminal 170 is a metal pin preferably made from drawn nickel-iron alloy wire. The first terminal 170 has a cylindrical outer surface 172 which extends parallel to a central axis 174 of the initiator 10. The axis 174 is coincident with the inflator axis 52 when the initiator 10 is assembled in the inflator 20, An inner end portion 176 of the first terminal 170 is brazed to the outer end surface 158 of the header 150. An outer end portion 180 of the first terminal 170 extends away from the header 150 in a direction parallel to the axis 174.

A second conductor pin or terminal 190 extends parallel to the first terminal 170. The second terminal 190 is made from the same material as the first terminal 170. The second terminal 190 has a cylindrical outer surface 192. An inner end portion 194 of the second terminal 190 extends axially through the opening 162 in the header 150. An inner end surface 196 of the second terminal 190 is coplanar with the inner end surface 156 of the header 150. An outer end portion 198 of the second terminal 190 extends away from the header 150 in a direction parallel to the axis 174.

A ferrite bead 200 (FIGS. 2 and 5) encircles the inner end portion 194 of the second terminal 190 and has an opening through which the end portion 194 passes. The ferrite bead 200 is made from an electrically non-conductive material, such as manganese zinc ferrite. The ferrite bead 200 fills the annular space between the inner end portion 194 of the second terminal 190 and the inner surface 160 of the header 150. The ferrite bead 200 electrically insulates between the header 150 and the inner end portion 194 of the second terminal 190. The ferrite bead 200 also provides RF attenuation for the initiator 10.

The initiator 10 also includes a retainer 210 (FIGS. 2 and 5), which is preferably made from machined or metal injection molded 304L stainless steel. A cylindrical side wall 212 of the retainer 210 has an inner end portion 214, an intermediate or shoulder portion 216, and an outer end portion 218. The inner end portion 214 (FIG. 5) of the side wall 212 has cylindrical inner and outer surfaces 220 and 224 and an annular radially extending inner end surface 228. A circumferential groove 226 having a rectangular cross-sectional configuration is formed on the outer periphery of the inner end portion 214 of the retainer 210.

The shoulder portion 216 (FIG. 2) of the retainer 210 has cylindrical inner and outer surfaces 230 and 232 which extend parallel to the axis 174. The inner surface 230 defines a passage extending axially through the retainer 210 and through which both terminals 170 and 190 extend. The inner surface 230 has the same diameter as the inner surface 220 of the inner end portion 214 of the side wall 212. The outer surface 232 has a larger diameter than the outer surface 224 of the end portion 214 so that a radially extending shoulder 234 is formed between the surfaces 232 and 224.

The outer end portion 218 of the retainer 210 has cylindrical inner and outer surfaces 240 and 242 which extend parallel to the axis 174. The outer surface 242 has the same diameter as the outer surface 232 of the shoulder portion 216 of the side wall 212. The inner surface 240 has a larger diameter than the inner surface 230 of the shoulder portion 216 so that a radially extending shoulder 236 is formed between the surfaces 240 and 230. An annular flange 250 extends radially outward from the outer end portion 218 of the side wall 212. The flange 250 has parallel radially extending inner and outer side surfaces 252 and 254 and an axially extending outer peripheral surface 256.

A glass-to-metal seal 260 (FIG. 2) interconnects the retainer 210, the header 150, the terminals 170 and 190, and the ferrite bead 200. To form the seal 260, a ground, pressed glass preform is assembled with the retainer 210, the header 150, the terminals 170 and 190, and the ferrite bead 200. This assembly is then heated to a temperature, typically about 1,900° F., at which the glass becomes semi-molten. The assembly is then allowed to cool.

When the glass seal 260 cools, it expands radially outward against and fuses to the surfaces 220 and 230 of the side wall 212 of the retainer 210. This expansion creates a compression seal between the glass seal 260 and the retainer 210. The glass seal 260 is a glass-like ceramic material which seals around and fuses to and structurally supports the header 150, the terminals 170 and 190, and the ferrite bead 200. The glass seal 260 completely spans the passage defined by the inner surface 230 of the retainer 210 and also spans the opening 160 in the header 150.

A bridgewire 270 (FIG. 2) extends between the inner end surface 196 of the second terminal 190 and the inner end surface 156 of the header 150. The bridgewire 270 is a thin metal resistance wire which heats up and generates thermal energy when an electric current of a predetermined magnitude passes through the bridgewire.

The bridgewire 270 extends through a portion of an ignition charge 280. The ignition charge 280 is a pyrotechnic material, preferably zirconium potassium perchlorate, which auto-ignites upon the application of sufficient thermal energy. The ignition charge 280 is disposed in abutting engagement with the inner end surface 156 of the header 150. The header 150 acts as a support for the ignition charge 280.

The ignition charge 280 is enclosed in an ignition cup 290. The ignition cup 290 is a cup-shaped metal member preferably made from drawn 304L stainless steel. The ignition cup includes a cylindrical side wall 292 and a circular end wall 294 formed as one piece with the side wall. The ignition cup 290 has an inner surface 296 and an outer surface 298. The walls 292 and 294 of the ignition cup 290 define a cavity 300 in which the ignition charge 280 is disposed. The side wall 292 of the ignition cup 290 overlies the portion of the cylindrical outer surface 152 of the header 150 in which the groove 154 is formed.

An annular inner locking ring 310 (FIGS. 2 and 5) extends circumferentially around the side wall 292 of the ignition cup 290. The locking ring 310 has a circular cross-sectional configuration and is made from a nickel-titanium shape-memory alloy. A preferred material is TINEL® brand alloy. Locking rings made from this material are available under the trademark UNILOK from Raychem Corporation Metals Division, 300 Constitution Drive, Menlo Park, Calif. The locking ring 310, when held below a predetermined temperature, typically room temperature, maintains a predetermined diameter. When heated above the predetermined temperature, the locking ring 310 shrinks in diameter about 6 percent.

During assembly of the initiator 10, the ignition cup 290 is placed over the header 150 with the ignition charge 280 disposed within the ignition cup. Before the locking ring 310 is shrunk onto the ignition cup 29, the side wall 292 of the ignition cup is not deformed radially inward as viewed in the drawings. Rather, the side wall 292 is cylindrical in configuration and does not extend into the groove 154 of the header 150.

The locking ring 310, in its expanded condition, is placed over the undeformed ignition cup 290 at a location radially outward of the groove 154 in the header 150. The locking ring 310 is then heated, and shrinks in diameter. The locking ring 310, when it shrinks, exerts a radially inwardly directed force on the side wall 292 of the ignition cup 290. A portion of the wall 292 of the ignition cup 290 deforms radially inward into the groove 154 of the header 150. The material of the outer wall 292 of the ignition cup 290, and possibly also the material of the header 150, is plastically deformed at the outer corners of the groove 154, creating 360° circumferential seals at those corners.

The locking ring 310 clamps the ignition cup 290 against the header 150 around the 360° perimeter of the ignition cup 290. The ignition cup 290 is thus permanently secured in position relative to the header 150 by the locking ring 310. The locking ring 310 creates a seal between the ignition cup 290 and the header 150, which may be a hermetic seal. It is not necessary to weld the ignition cup 290 to the header 150, even though the ignition cup is made from metal rather than plastic so that a good seal can be created between the ignition cup and the header.

An insulation cup 320 (FIGS. 2, 3 and 5) overlies the ignition cup 290. The insulation cup 320 is a cup-shaped member made from a resilient, electrically non-conductive material, preferably injection molded or blow-formed nylon. The insulation cup 320, has an axially extending cylindrical side wall 322 (FIG. 3) and a radially extending circular end wall 324 formed as one piece with the side wall 322. The side wall 322 has parallel inner and outer side surfaces 326 and 328. The end wall 324 has parallel inner and outer surfaces 330 and 332.

A portion of the side wall 322 of the insulation cup 320 is bowed radially outwardly as indicated at 336 and defines a circumferentially extending groove 338 in the side wall of the insulation cup. An annular flange 340 of the insulation cup 320 extends radially outward from the lower end (as viewed in FIG. 2) of the side wall 322 of the insulation cup 320. The flange 340 (FIG. 5) has parallel radially extending inner and outer side surfaces 342 and 344.

The insulation cup 320 is assembled in the initiator 10 by sliding the insulation cup axially, in the direction indicated by the arrow 348 (FIG. 3) over the ignition cup 290 and the locking ring 310. The insulation cup 320 snaps over the assembled ignition cup 290 and locking ring 310 and is retained in place by the resilience of the material of the insulation cup. The end wall 324 of the insulation cup 320 overlies the end wall 294 of the ignition cup 290. The side wall 322 of the insulation cup 320 overlies the side wall 292 of the ignition cup 290. The locking ring 310 is received in the groove 338 in the insulation cup 320. The outer side surface 344 of the flange 340 of the insulation cup 320 is in abutting engagement with the inner end surface 228 of the retainer 210. The flange 340 is, preferably, ultrasonically welded to the retainer 210 at this area of abutting engagement.

An output charge 350 (FIGS. 2 and 4) of the initiator 10 is enclosed in an output cup 360. The output charge 350 is a pyrotechnic material, preferably $BKNO_3$, which upon being ignited by the ignition charge 280 generates hot gases to ignite the disks 110 (FIG. 1) of gas generating material in the inflator 20. The output charge 350 is typically made from an electrically conductive material.

Figure 2:
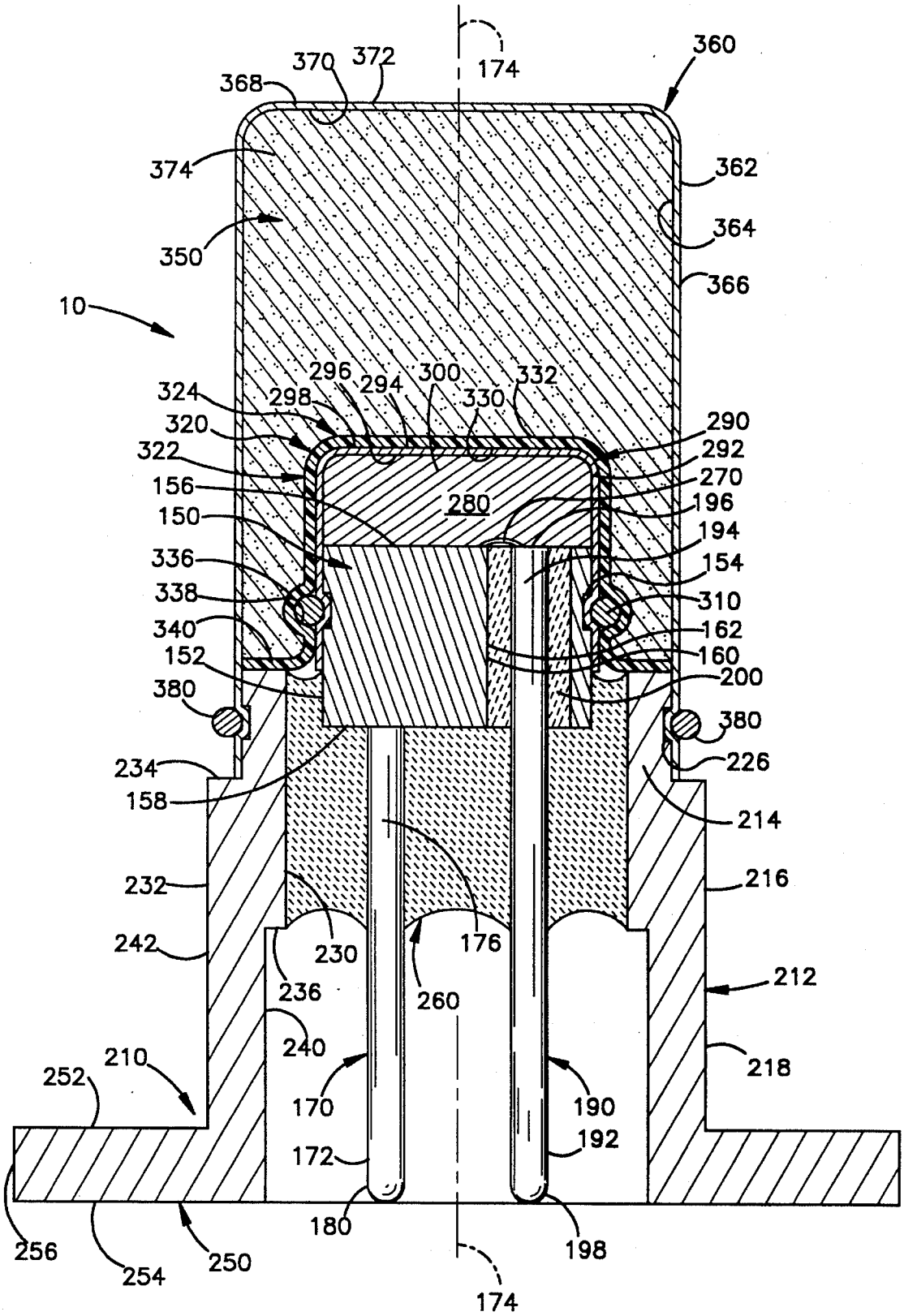
FIG. 2 is an enlarged sectional view of the initiator of FIG. 1.

The output cup 360 (FIGS. 2 and 4) is a cup-shaped metal member preferably made from drawn 304L stainless steel. The output cup has an axially extending cylindrical side wall 362 with parallel inner and outer side surfaces 364 and 366 (FIG. 2). A radially extending circular end wall 368 of the output cup 360 is formed as one piece with the side wall 362. The end wall 368 has parallel inner and outer side surfaces 370 and 372. The walls 362 and 368 of the output cup 360 define a cavity 374 in which the output charge 350 is disposed.

Figure 4:
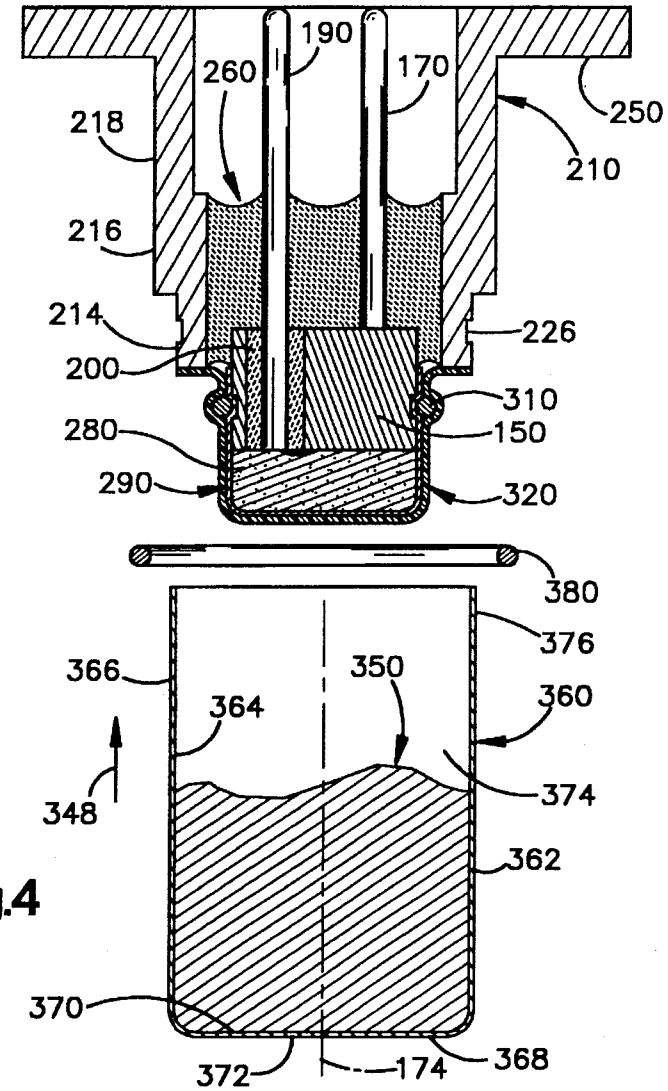
FIG. 4 is an view similar to FIG. 3 showing another step in the assembly of the initiator of FIG. 2.
Figure 3:
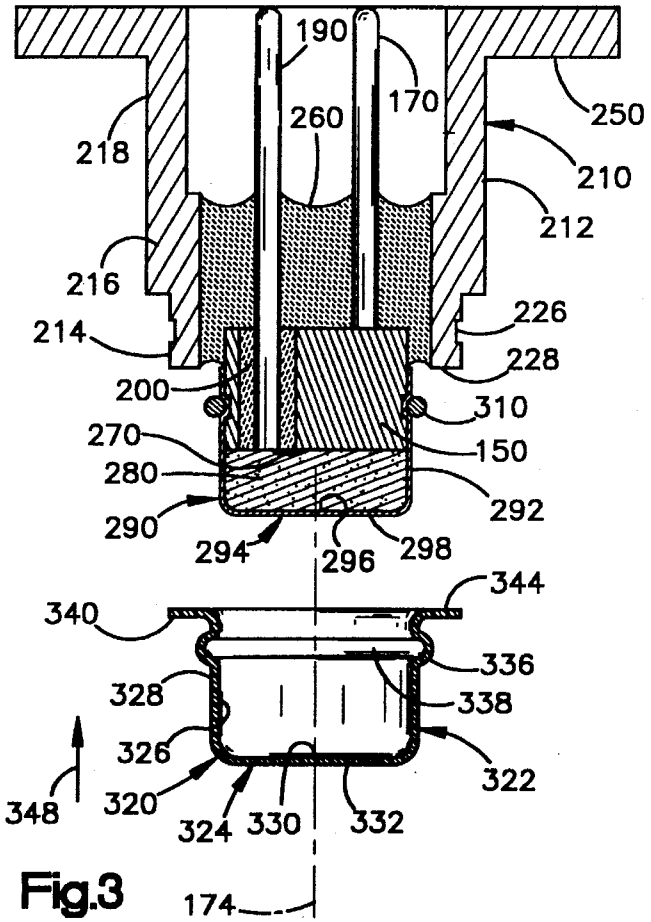
FIG. 3 is an exploded sectional view with parts removed showing one step in the assembly of the initiator of FIG. 2.

In assembly of the initiator 10, the output charge 350 is placed as loose powder within the output cup 360 in an orientation as shown in FIG. 4. The output cup 360 with its enclosed output charge 350 is then moved axially into engagement with the other parts of the initiator 10, in a direction as indicated by the arrow 348 in FIG. 4. The powder material of the output charge 350 deforms to assume the shape of the insulation cup 320 as illustrated in FIG. 2. A cylindrical end portion 376 (FIG. 4) of the output cup 360 overlies the groove 226 in the retainer side wall 212 and abuts the shoulder 234 in the retainer side wall.

Figure 5:
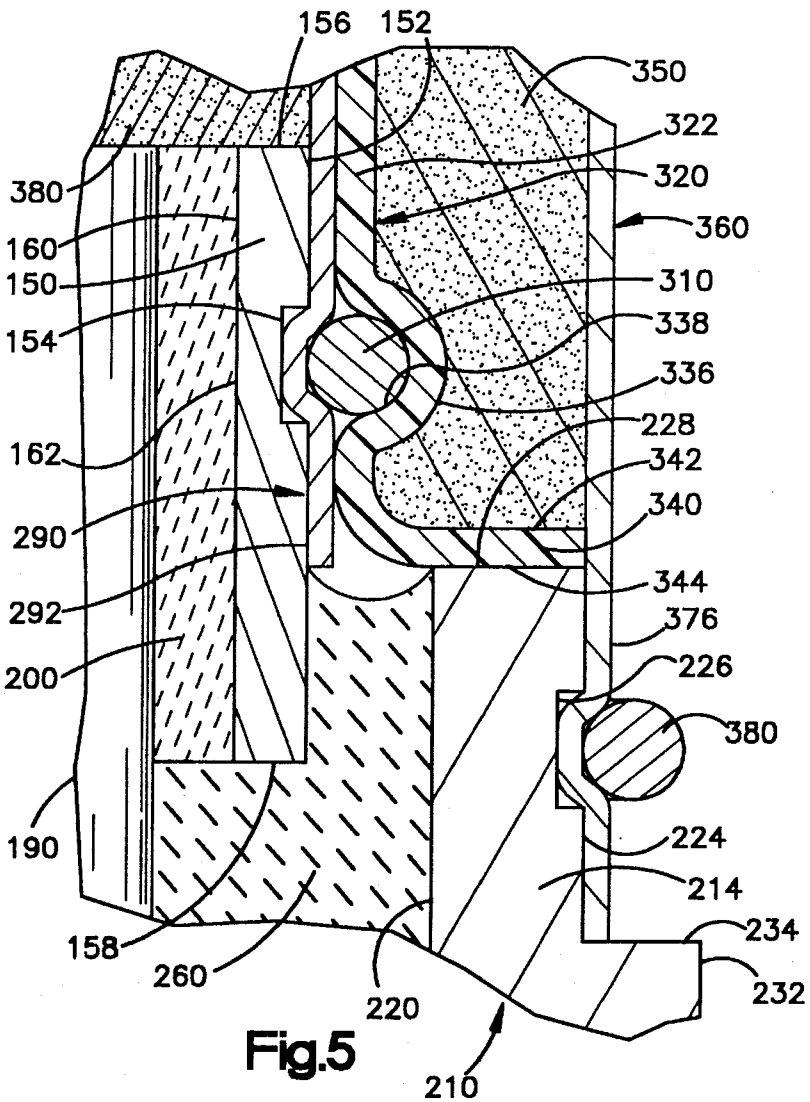
FIG. 5 is an enlarged view of a portion of the initiator of FIG. 2.

An outer locking ring 380 (FIGS. 2, 4, and 5) is then placed around the end portion 376 of the side wall 362 of the output cup 360, at a location radially outward of the groove 226 in the retainer 210. The outer locking ring 380 is made from the same material as the inner locking ring 310. The outer locking ring 380, after being positioned around the output cup 360, is heated and shrinks to a smaller diameter. The outer locking ring 380, when it shrinks, exerts a radially inwardly directed clamping force on the side wall 362 of the output cup 360. The clamping force exerted by the outer locking ring 380 deforms the side wall 362 of the output cup 360 radially inwardly into the groove 226 in the header 210, as illustrated in FIGS. 2 and 5. The outer locking ring 380 thus physically secures and maintains the output cup 360 in position relative to the retainer 210.

The outer locking ring 380 also provides a hermetic seal between the output cup 360 and the retainer 210. The metal of the output cup side wall 362 is plastically deformed against the edges of the groove 226 in the retainer 210. A hermetic seal is created at these locations. Contaminants, including moisture, are blocked from entering into the cavity 374 in the output cup 360, through the joint between the output cup and the retainer 210. It is not necessary to weld the output cup 360 to the retainer 210, even though the output cup is made from metal rather than plastic to seal better against the retainer 210.

The initiator 10, once assembled, is attached to the combustion chamber cover 46 (FIG. 1), preferably by welding. The flange 250 of the retainer 210 is continuously welded to the cover 46 at a circumferential weld location 384. The cover 46 is then welded to the combustion cup 44. The initiator 10 is thereby secured in position in the inflator 20. It should be noted that the initiator 10 can be secured to the cover 46 by other means. For example, it is contemplated that the retainer 210 and cover 46 may have complementary threaded portions which would permit the retainer and cover to be screwed together. The terminals 170 and 190 of the initiator 10 are connected with vehicle circuitry (not shown) which includes a collision sensor such as a deceleration sensor and a power source such as the vehicle battery.

Upon the occurrence of a collision or other sudden vehicle deceleration the collision sensor closes an electrical circuit. An electric current flows through the terminals 170 and 190 to the bridgewire 270. The bridgewire 270 heats up and sets off the ignition charge 280 which ignites the output charge 350. Ignition of the output charge 350 forms hot gas products which flow outwardly from the initiator 10 and rupture the inner top wall 102 and the inner side wall 98 of the canister 90. The hot gas from the initiator 10 ignites the disks 110 of gas generating material. The disks 110 of gas generating material rapidly produce a large volume of another hot gas.

The pressure of the gas acts on the cylindrical side wall 96 of the canister 90, forcing the side wall 96 radially outwardly against the combustion cup side wall 60. This results in the thin side wall 96 of the canister 90 being ruptured or blown out at the openings 68 in the combustion cup side wall 60. The reduced thickness of the side wall 96 adjacent the openings 68 allows this portion of the side wall 96 to rupture in preference to other portions at a desired pressure. The gas generated by burning of the disks 110 then flows radially outwardly through the prefilter 120. The prefilter 120 removes from the flowing gas some combustion products of the initiator 10 and of the gas generating disks 110. The prefilter 120 also cools the flowing gas. When the gas cools, molten products are plated onto the prefilter 120. The gas flows through the openings 68 and into the slag screen 122.

The slag screen 122 removes and traps particles from the flowing gas. The slag screen also cools the flowing gas. When the gas cools, molten combustion products are plated onto the slag screen 122. The filter shield 126 between the slag screen 122 and the final filter assembly 124 causes turbulent flow of gas to occur in and around the slag screen 122. The turbulent gas flow promotes the retention of relatively heavy particles in the slag screen 122 and in the lower portion of the diffuser cup 42.

The gas flows axially upwardly from the slag screen 122 to the final filter assembly 124. The gas then flows radially outwardly through the final filter assembly 124 which removes small particles from the gas. The final filter assembly 124 also further cools the gas so that molten products in the gas may deposit on parts of the final filter assembly 124. The annular array of gas outlet openings 58 directs the flow of gas into an air bag (not shown) to inflate the air bag.

When the inflator 20 is in an unactuated condition, it is desirable to seal the pyrotechnic material, including the ignition charge 280 and the output charge 350, hermetically in the inflator. Thus, the outer locking ring 380 provides a hermetic seal between the output cup 360 and the retainer 210. The glass-to-metal seal 260 provides a hermetic seal between itself and the retainer 210, the header 150, the terminals 170 and 190, and the ferrite bead 200. The locking ring 310 can also provide a hermetic seal between the ignition cup 290 and the header 150. The seals provided by the glass seal 260, the outer locking ring 380, and the inner locking ring 310 block the conduction of contaminants, including moisture, from the ambient environment into the ignition charge 280 and the output charge 350. No welding of the ignition cup 290 or the output cup 360 is necessary to obtain this result.

The pyrotechnic material of the ignition charge 280 is electrically sensitive. That is, if sufficient electrical current (as opposed to thermal energy) is passed through the ignition charge 280, the ignition charge can be actuated. It is therefore necessary to block the flow of electric current through the ignition charge 280 to prevent unintended actuation of the ignition charge and of the initiator 10. The glass seal 260 is an electric insulator and helps to block the flow of electric current from the retainer 210 or from the output cup 360 into the ignition charge. The metal ignition cup 290, however, is in direct contact with the ignition charge 280 and is electrically conductive. It is therefore necessary to block the flow of electric current into the ignition cup 290, for example from the electrically conductive output charge 350 and the metal output cup 360.

The insulation cup 320 is made from an electrically non-conductive material and overlies substantially the entire ignition cup 290. The insulation cup 320 electrically insulates the exterior of the ignition cup. Electric current or sparks can not pass from the output cup 360 or the output charge 350 into the ignition cup 290, because of the presence of the insulation cup 320. Thus, the only path through which electric current can flow into the ignition charge 280 is through the bridgewire 270. The ignition charge 280 is electrically isolated from any stray electric charge which might be applied to any external part of the initiator 10. As a result, no plastic covering is needed over, for example, the output cup 360.

Figure 6:
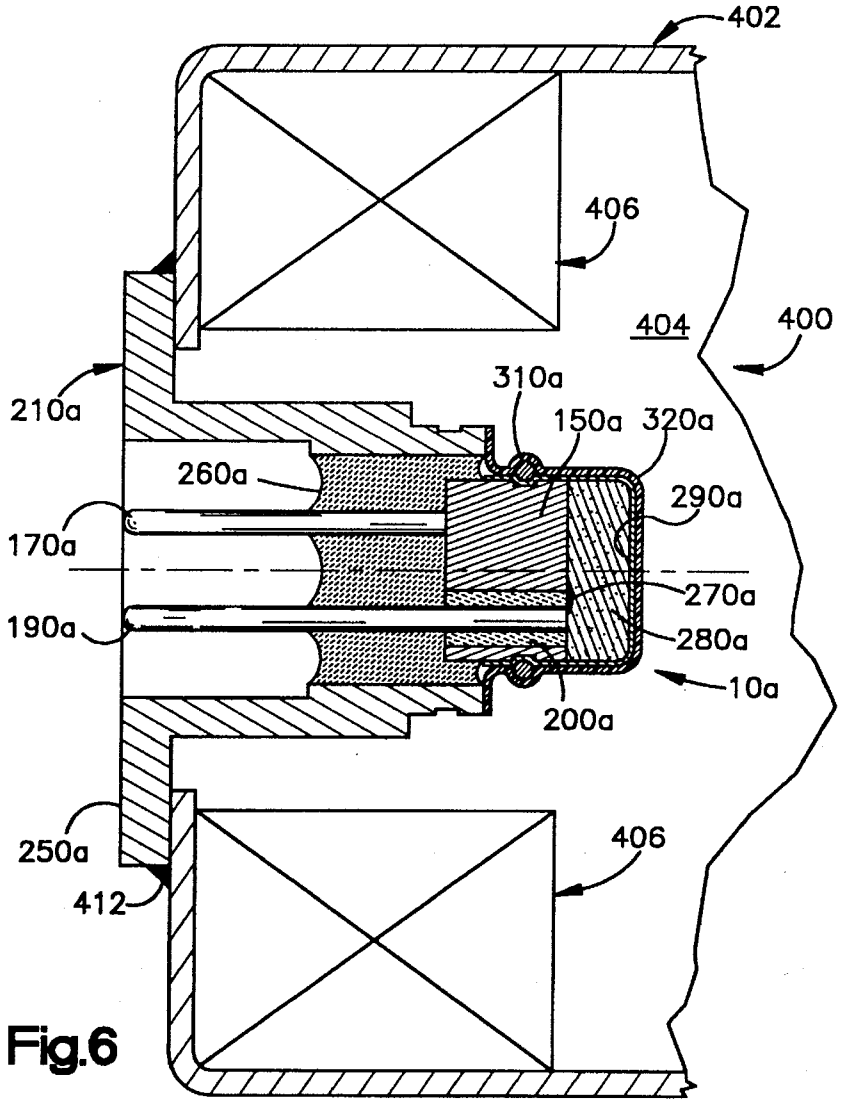
FIG. 6 is a schematic sectional view of an inflator and initiator assembly constructed in accordance with a second embodiment of the present invention.

FIG. 6 illustrates schematically a portion of an inflator 400 which includes an initiator 10*a* constructed in accordance with a second embodiment of the invention. The initiator 10*a* is identical in construction to the initiator 10 (FIGS. 1–5), except that the initiator 10*a* does not include the output charge 350, the output cup 360, or the outer locking ring 380. Parts of the initiator 10*a* which are identical to corresponding parts of the initiator 10 are in FIG. 6 given the same reference numeral as in FIGS. 1–5 but with the suffix "a" attached.

The inflator 400 is an augment or hybrid type inflator. The inflator 400 includes a container, a portion of which is indicated at 402. The container 402 defines a chamber 404 within the inflator 400. A body of pyrotechnic material indicated schematically at 406 is disposed within the chamber 404. A quantity of gas such as argon or nitrogen is also disposed within the chamber 404 in the container 402. The gas is stored under pressure in the chamber 404.

The initiator 10*a* includes a retainer 150*a*, a ferrite bead 200*a*, terminals 170*a* and 190*a*, and a glass seal 260*a*. The initiator 10*a* also includes a bridgewire 270*a*, an ignition charge 280*a*, an ignition cup 290*a*, an inner locking ring 310*a*, and an insulation cup 320*a*. A flange portion 250*a* of the retainer 210*a* is welded at 412 to the container 402. The initiator 10*a* projects into the chamber 404 in the container 402 and is exposed to the pressure of the gas stored in the chamber 404.

When the inflator 400 is actuated, electric current flows through the terminals 170*a* and 190*a*. The bridgewire 270*a* heats up and ignites the ignition charge 280*a*. The ignition charge 280*a* ignites the pyrotechnic material 406. The pyrotechnic material 406 generates gas for inflating an air bag (not shown). The ignition of the ignition charge 280*a* also results in rupturing of a predetermined gas outlet portion (not shown) of the container 402 to release the gas stored in the container. The gas stored in the container, heated and augmented by the gas generated by the pyrotechnic material 406, is directed into an air bag (not shown) to inflate the air bag.

The initiator 10*a* is directly exposed to the pressure of the gas stored in the chamber 404. This pressure is typically about 5,000 psi. The glass-to-metal seal 260*a* is a structural member which resists this pressure. The glass-to-metal seal 260*a* provides structural support for the retainer 10*a*, and for the internal parts of the initiator 10*a* including the header 150*a*, the terminals 170*a* and 190*a*, and the ferrite bead 200*a*, securing these parts to the retainer 210*a*. The glass-to-metal seal 260*a* blocks movement of these parts of the initiator 10*a* out of the inflator 400.

The glass-to-metal seal 260*a* in the illustrated embodiment has a length-to-diameter ratio of about 0.7:1. This ratio has been found to provide sufficient structural strength to enable placement of the initiator 10*a* in direct contact with, and exposure to, the pressure of the stored gas in the chamber 404. This desired amount of structural strength has been found to be present in glass-to-metal seals having a length-to-diameter ratio in the range from about 0.7:1 to about 1:1 or more. Glass-to-metal seals of this type which have a length-to-diameter ratio substantially greater than 1:1, such as 7:1, have been found not to have the structural strength needed to withstand the high gas pressures in an augment inflator. Because of the structural strength provided by the glass-to-metal seal 260*a*, the initiator 10*a* is capable of withstanding the high pressures of the stored gas in the augment inflator 400.

From the above description of the invention, those skilled in the art will perceive improvements, changes and modifications in the invention. Such improvements, changes and modifications within the skill of the art are intended to be covered by the appended claims.

Having described the invention, I claim:

1. An electrically actuatable initiator comprising:

a retainer;

at least one terminal for electrical connection with vehicle circuitry;

means for supporting said terminal in spaced relation to said retainer and for providing electrical insulation between said terminal and said retainer;

a bridgewire associated with said terminal for, when electrically actuated by current from said terminal, generating thermal energy;

an ignition charge ignitable by said thermal energy;

a metal ignition cup enclosing and supporting said ignition charge, said metal ignition cup being spaced apart from said retainer;

means for electrically insulating said metal ignition cup, comprising a plastic insulation cup overlying said metal ignition cup;

an electrically conductive output charge overlying said insulation cup; and an electrically conductive output cup overlying said output charge, said insulation cup blocking flow of electric current from said output charge or said output cup to said ignition cup.

2. An initiator as set forth in claim 1 wherein said insulation cup includes a radially extending flange portion in abutting engagement with said retainer.

3. An initiator as set forth in claim 1 further comprising a locking ring member clamping said ignition cup on said means for supporting said terminal, said insulation cup having surfaces defining an annular groove in said insulation cup, said locking ring member being disposed in said groove and engaging said surfaces defining said groove to block movement of said insulation cup relative to said ignition cup.

4. An initiator as set forth in claim 1 wherein said ignition cup has a cylindrical side wall and a circular end wall, said insulation cup having a cylindrical side wall overlying said side wall of said ignition cup and a circular end wall overlying said end wall of said ignition cup.

5. An initiator as set forth in claim 1 wherein said means for supporting and for providing comprises:

an electrically conductive header in electrical contact with said ignition charge and with said bridgewire and with said ignition cup; and a glass-to-metal seal electrically insulating between said retainer and said terminal and said header.

6. An initiator as set forth in claim 5 wherein said glass-to-metal seal has a length-to-diameter ratio in the range of from about 0.7:1 to about 1:1.

7. An initiator as set forth in claim 1 wherein said means for supporting and for providing comprises:

an electrically conductive header in electrical contact with said ignition charge and with said bridgewire and with said ignition cup; and a glass-to-metal seal, said glass-to-metal seal providing electrical insulation between (i) said retainer and said terminal and said header and (ii) said terminal and said header.

8. An electrically actuatable initiator for use in an air bag inflator, said initiator comprising:

a metal retainer for connecting said initiator with the inflator;

a metal header;

at least one metal terminal for electrical connection with vehicle circuitry;

a glass-to-metal seal supporting said terminal in spaced relation to said header and said retainer and providing electrical insulation between said terminal and said retainer;

an ignition charge in electrical contact with said metal header;

a metal ignition cup enclosing said ignition charge, said metal ignition cup being in electrical contact with said metal header and with said ignition charge;

a plastic insulation cup overlying said metal ignition cup; and a metal output cup containing an output charge overlying said ignition cup, said metal output cup being in electrical contact with said metal retainer and with said output charge;

said plastic insulation cup electrically insulating between (a) said ignition cup and (b) said output cup and said output charge.

9. An initiator as set forth in claim 8 wherein said retainer is electrically connected with vehicle circuitry, said glass-to-metal seal electrically insulating between said retainer and said ignition charge.

10. An initiator as set forth in claim 8 further comprising a locking ring member securing said output cup to said retainer, said locking ring member being made from a shape-memory alloy.

11. An initiator as set forth in claim 10 wherein said locking ring member is movable by change of temperature between a first condition when maintained at a temperature below a predetermined temperature and a second condition after being at a temperature above the predetermined temperature, said locking ring member having a first diameter when in the first condition and having a second diameter less than said first diameter when in the second condition, said locking ring member when in the second condition exerting a radially inwardly directed force on said output cup to clamp said output cup onto said retainer.

12. An apparatus comprising:

a first electrically conductive metallic member having first surface means for defining a first passage extending through said first member;

a second electrically conductive metallic member spaced apart from said first member, said second member having second surface means for defining a second passage extending through said second metallic member, said first and second passages extending generally parallel to an axis of said apparatus;

an electrically conductive first metallic electrode bonded to said second member and extending through said first passage in said first member;

an electrically conductive second metallic electrode extending through said first passage in said first member and through said second passage in said second member, said first and second electrodes extending generally parallel to said axis, said second passage having a second passage portion encircling said second metallic electrode;

a first body of solid electrically insulating ceramic material fused to said first surface means defining said first passage in said first member and spanning said first passage, said first body being fused to said first and second electrodes in said first passage, said first body also being fused to said second member and spanning said second passage portion between said second electrode and said second member; and a second body of solid electrically insulating ferrite material in said second passage portion in said second member, said second body having an opening through which said second electrode passes.

13. An apparatus as set forth in claim 12 including a resistance wire extending between said second electrode and said second member and completing an electric circuit between said first electrode and said second electrode, said resistance wire generating thermal energy when electrically actuated by current from said second electrode.

14. An apparatus as set forth in claim 13 further comprising an ignition charge supported on said second member and ignitable by said thermal energy.

15. An apparatus as set forth in claim 14 further comprising a metal ignition cup enclosing and supporting said ignition charge, said metal ignition cup being spaced apart from said first member, and means for electrically insulating said metal ignition cup, said means for electrically insulating comprising a plastic insulation cup overlying said metal ignition cup.

16. An apparatus as set forth in claim 12 further comprising:

a bridgewire associated with said second electrode for, when electrically actuated by current from said second electrode, generating thermal energy;

an ignition charge ignitable by said thermal energy;

a metal ignition cup enclosing and supporting said ignition charge, said metal ignition cup being spaced apart from said first member;

means for electrically insulating said metal ignition cup, said means for electrically insulating comprising a plastic insulation cup overlying said metal ignition cup;

an electrically conductive output charge overlying said insulation cup; and an electrically conductive output cup overlying said output charge, said insulation cup blocking flow of electric current from said output charge or said output cup to said ignition cup.

17. An apparatus as set forth in claim 12 wherein said first and second electrodes are substantially straight, said first body of ceramic material completely spanning said first passage and completely spanning said second passage portion between said second electrode and said second member, said second body of ferrite material substantially filling said second passage portion in said second member.

18. An electrically actuatable initiator comprising:

a metal support member;

a pyrotechnic charge supported by said support member;

an electrical conductor extending through said support member;

means for igniting said pyrotechnic charge in response to the conduction of electric current through said electrical conductor;

a metal cover, said metal cover encircling said pyrotechnic charge, an inner major side surface of said cover being in abutting engagement with said pyrotechnic charge;

an output charge spaced from said pyrotechnic charge;

a metal output cup, said metal output cup encircling said output charge and said metal cover, an inner major side surface of said output cup being in abutting engagement with said output charge;

means for electrically insulating said pyrotechnic charge from electric current not conducted through said electrical conductor; and sealing means for sealing said cover to said support member;

said sealing means comprising a locking ring member circumscribing said cover and compressing said cover radially inward onto said support member to seal said cover to said support member.

19. An initiator as set forth in claim 18 wherein said cover has a cylindrical side wall and a circular end wall formed as one piece with said side wall, said support member including surface means for defining a peripheral groove on said support member, said side wall of said cover being deformed radially inward into said groove in said support member by said locking ring member.

20. An initiator as set forth in claim 18 wherein said support member comprises an electrically conductive header supporting said electrical conductor, said header having an outer peripheral groove, a side wall of said cover being deformed radially inward into said groove in said header by said locking ring member.

21. An initiator as set forth in claim 18 wherein said locking ring member is made from a nickel-titanium shape-memory alloy.

22. An initiator as set forth in claim 18 wherein said locking ring member is movable by change of temperature between a first condition when maintained at a temperature below a predetermined temperature and a second condition after being at a temperature above the predetermined temperature, said locking ring member having a first diameter when in the first condition and having a second diameter less than said first diameter when in the second condition, said locking ring member when in the second condition exerting a radially inwardly directed force on said cover to clamp said cover onto said support member.

23. An electrically actuatable initiator comprising:

a retainer;

a metal support member spaced apart from said retainer;

a pyrotechnic charge supported by said support member;

an electrical conductor extending through said support member;

means for igniting said pyrotechnic charge in response to the conduction of electric current through said electrical conductor;

a metal cover encircling said pyrotechnic charge;

an output charge spaced from said pyrotechnic charge;

a metal output cup encircling said output charge and said metal cover;

sealing means for sealing said cover to said support member;

sealing means for sealing said output cover to said retainer; and a glass-to-metal seal abutting said retainer, said header, and said terminal, said glass-to-metal seal providing electrical insulation between said retainer and said header and said terminal.

24. An initiator as set forth in claim 23 wherein said cover is an output cup having an outer major side surface forming an outer surface of said initiator, said support member comprising a retainer having an outer peripheral groove, a side wall of said cover being deformed radially inward into said groove in said retainer by said locking ring member.

25. An initiator as set forth in claim 23 comprising a second support member, a second pyrotechnic charge, a second cover for said second pyrotechnic charge, and means for sealing said second cover to said second support member, said means for sealing said second cover to said second support member comprising a second locking ring member circumscribing said second cover and compressing said second cover radially inward to seal said second cover to said second support member.

26. An initiator as set forth in claim 23 comprising a glass-to-metal seal having a length-to-diameter ratio in the range of from about 0.7:1 to about 1:1.

* * * * *